US007694478B2

(12) United States Patent
Zahner

(10) Patent No.: US 7,694,478 B2
(45) **Date of Patent: *Apr. 13, 2010**

(54) PANEL ATTACHMENT SYSTEM

(75) Inventor: L. William Zahner, Kansas City, MO (US)

(73) Assignee: A. Zahner Company, Kansas City, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/685,924

(22) Filed: Mar. 14, 2007

(65) Prior Publication Data

US 2007/0175157 A1 Aug. 2, 2007

Related U.S. Application Data

(63) Continuation of application No. 10/716,836, filed on Nov. 19, 2003, now Pat. No. 7,210,273.

(51) Int. Cl.
*E04B 5/00* (2006.01)
*E04B 5/48* (2006.01)

(52) U.S. Cl. ..... 52/302.3; 52/302.1; 52/489.1; 52/483.1; 52/463; 52/466; 52/469

(58) Field of Classification Search ..... 52/762, 52/476, 475.1, 466, 483.1, 489.1, 506.09, 52/507, 510, 282.3, 302.3, 302.1, 463, 464, 52/200, 462, 469, 511
See application file for complete search history.

(56) References Cited

U.S. PATENT DOCUMENTS

| | | | | |
|---|---|---|---|---|
| 2,590,708 | A * | 3/1952 | Jurasevich | 52/464 |
| 2,653,686 | A * | 9/1953 | Routt | 52/506.08 |
| 2,841,255 | A * | 7/1958 | Kemp | 52/395 |
| 3,336,705 | A * | 8/1967 | Buck et al. | 52/222 |
| 3,376,680 | A * | 4/1968 | Gyekis | 52/463 |
| 4,964,257 | A * | 10/1990 | Kurose | 52/741.1 |
| 4,979,345 | A * | 12/1990 | Celsi | 52/481.1 |
| 5,125,204 | A * | 6/1992 | Porter | 52/393 |
| 5,363,624 | A * | 11/1994 | Cotter | 52/547 |
| 5,845,447 | A * | 12/1998 | Bodine et al. | 52/506.09 |
| 5,996,306 | A * | 12/1999 | Rionde | 52/769 |
| 6,164,024 | A * | 12/2000 | Konstantin | 52/200 |
| 6,536,175 | B2 * | 3/2003 | Conterno | 52/489.1 |

* cited by examiner

*Primary Examiner*—Phi Dieu Tran A
(74) *Attorney, Agent, or Firm*—Hovey Williams LLP

(57) ABSTRACT

A panel attachment system (10) comprising a plurality of covering panels (12), a plurality of retaining members (16) to hold the panels (12), and a plurality of mounting structures (18) to secure the retaining members (16) to a surface (20). The panels (12) are held to the retaining members (16) through the use of protruding locking members (32) formed on the panels (12) which interlock with a slot (48) formed on the retaining member (16). The panels (12) may be coupled to the retaining members (16) without the need for precise alignment, thereby expediting the installation of the surface (20). The retaining members (16) additionally contain a drainage channel (50) to carry water and other debris away from the surface (20).

14 Claims, 4 Drawing Sheets

PANEL ATTACHMENT SYSTEM

RELATED APPLICATION

The present application is continuation application and claims priority benefit, with regard to all common subject matter, of earlier-filed U.S. non-provisional patent application titled "PANEL ATTACHMENT SYSTEM," Ser. No. 10/716,836, filed Nov. 19, 2003 now U.S. Pat. No. 7,210,273. The identified earlier-filed application is hereby incorporated by reference into the present application.

BACKGROUND OF THE INVENTION

1. Field of the Invention

The present invention is broadly concerned with a panel attachment system. More particularly, the present invention is concerned with a panel attachment system which produces a finished surface on a roof, wall, or other surface having an overall smooth, planar configuration in which adjacent planar panels are attached to secondary support members which form a recessed joint incorporating a concealed drainage channel.

2. Description of the Prior Art

Prior art panel attachment systems for vertical, sloped or horizontal surfaces employ standing seams secured against moisture penetration by battens or soldered interlocking seams. Both methods produce an upstanding seam which extends outwardly from the surfaces of the panels and thus, the overall finished appearance of surfaces incorporating such seams is not smooth and flat.

The upstanding seams are secured by crimping, interlocking, or soldering to prevent penetration of moisture to the back sides of the panels and the underlying roof or wall surface. These attachment points are rigidly fixed, and consequently thermal expansion and contraction stresses accumulate around these points, causing wear. Moreover, the strength of such panel systems is often dependent upon the secondary clips or fasteners.

Previous interlocking "flat" seams depend on a gasket or sealant as a barrier to moisture infiltration. Such seams are subject to deterioration caused by exposure to temperature extremes and ultraviolet radiation, in addition to wear caused by thermally induced movement of panels.

Additionally, installation of panels using previous attachment systems requires fastening the panels into fixed positions with exposed fasteners or clips, interlocking the seams by aligning and engaging battens over the clips, or by crimping or secondary machine seaming. Skilled labor and specialized crimping and seaming machinery are required for such installation. Furthermore, single panels damaged during installation or thereafter cannot easily be removed without affecting adjacent panels.

Other panel attachment systems known in the art require precise alignment of roofing panels with small mounting elements thereby requiring the expense of time and effort in aligning the panels. Additionally, contraction and expansion of roofing panels further complicates the process of aligning roofing panels with small mounting elements, as the location of the mounting elements varies as metal contracts and expands.

Accordingly, there is a need for an improved panel attachment system that overcomes the limitations of the prior art. More particularly, there is a need for a system that is quick and easy to install without requiring precise alignment of roofing panels or exposing a drainage system or mounting elements.

SUMMARY OF THE INVENTION

The present invention overcomes the problems previously outlined and provides an improved panel attachment system. More particularly, the present invention provides a panel attachment system which produces a finished surface having an overall smooth, planar configuration in which adjacent planar panels are attached to secondary support members which form a recessed joint incorporating a concealed drainage channel.

Broadly speaking, the system includes a plurality of panels, retaining members for holding the panels, and mounting structures for securing the retaining members to a surface, such as a rood. Longitudinal edges of the panels are formed into flanges which present protruding locking members at spaced intervals for engaging a substantially continuous slot formed in the retaining members. The locking members may be flaps, hooks, barbs, or other similar elements, provided that the engagement of the locking member in the slot holds the panel to the retaining member. The retaining member is attached to the mounting structure which is fixedly secured to the roof or other building surface. The retaining member includes a drainage channel, which collects water, dirt, and other runoff that passes through the slot.

In operation, the mounting structures are aligned and secured to the surface and the retaining members are aligned and attached to the mounting structures. The panels are secured to the retaining members by forcing the panel's flanges and protruding locking members into the slot, thereby preventing the panel from separating from the retaining member. Thus, the panels may be secured to the retaining members in a manner which covers the entire surface and conceals the drainage channel and mounting structures, without requiring precise alignment of small mounting elements.

The panel attachment system of the present invention provides a flat, strong, moisture proof joint between adjacent panels having an inverted seam rather than a batten or standing seam. Advantageously, since battens or joint covers are not employed, a surface may be installed in a single operation and it is not necessary to walk back over the surface to attach joint covers. Since the panel flanges may be inserted into the slots at any location, there is no need for precise and time consuming alignment of panels to retaining members. Also, individual panels in the system can be removed easily without affecting adjacent panels.

In addition to eliminating the need for precise alignment, the present invention also allows for the full expansion and contraction of the panels and the retaining member without damaging or otherwise harming the panels' connection to the surface as fixed fasteners, such as nails, screws, or bolts, are not needed to secure the panels to the retaining members. Also, there are no exposed fasteners, as fasteners employed to secure the retaining members and mounting structures are covered by the panels.

BRIEF DESCRIPTION OF THE DRAWING FIGURES

A preferred embodiment of the present invention is described in detail below with reference to the attached drawing figures, wherein.

Figure 1:
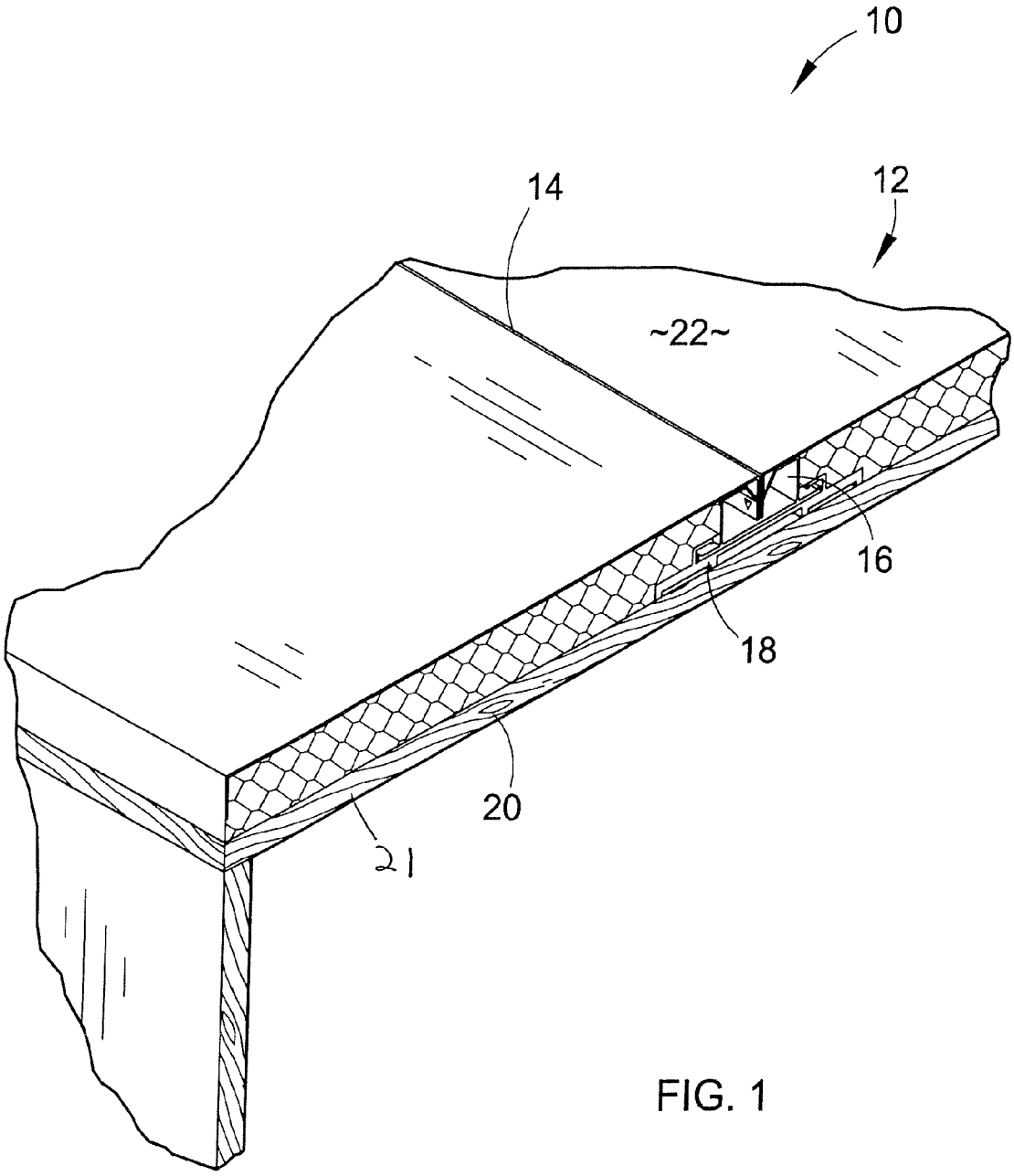
FIG. 1 is a fragmentary perspective view of a finished surface in accordance with the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE PREFERRED EMBODIMENTS

Referring now to the drawings and in particular FIG. 1, a panel attachment system 10 constructed in accordance with a preferred embodiment of the present invention broadly includes a plurality of covering panels 12 installed in an adjacent, side-by-side relationship with a recessed joint 14 therebetween, a plurality of retaining members 16 to hold the panels 12, and a plurality of mounting structures 18 to secure the retaining members 16 to a surface 20. A variety of surfaces may be covered with the present invention, including roofs, exterior walls, interior walls or other architectural elements. The system 10 may also include components which are similar to those illustrated and described in U.S. Pat. No. 5,394,666, which is incorporated herein by specific reference.

Figure 2:
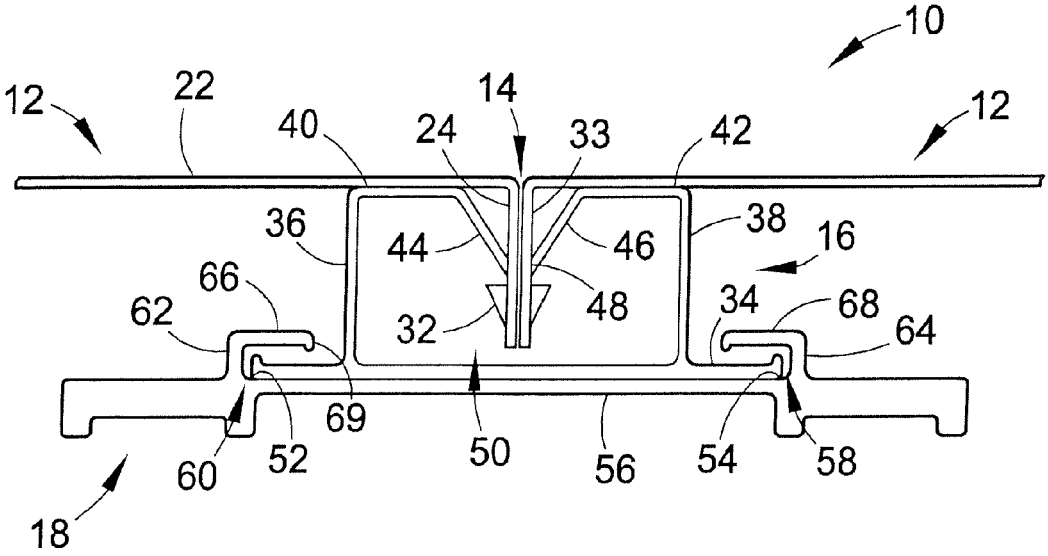
FIG. 2 is a vertical cross sectional view of a panel attachment system constructed in accordance with a preferred embodiment of the present invention having a plurality of panels, retaining member and mounting structure.
Figure 3:
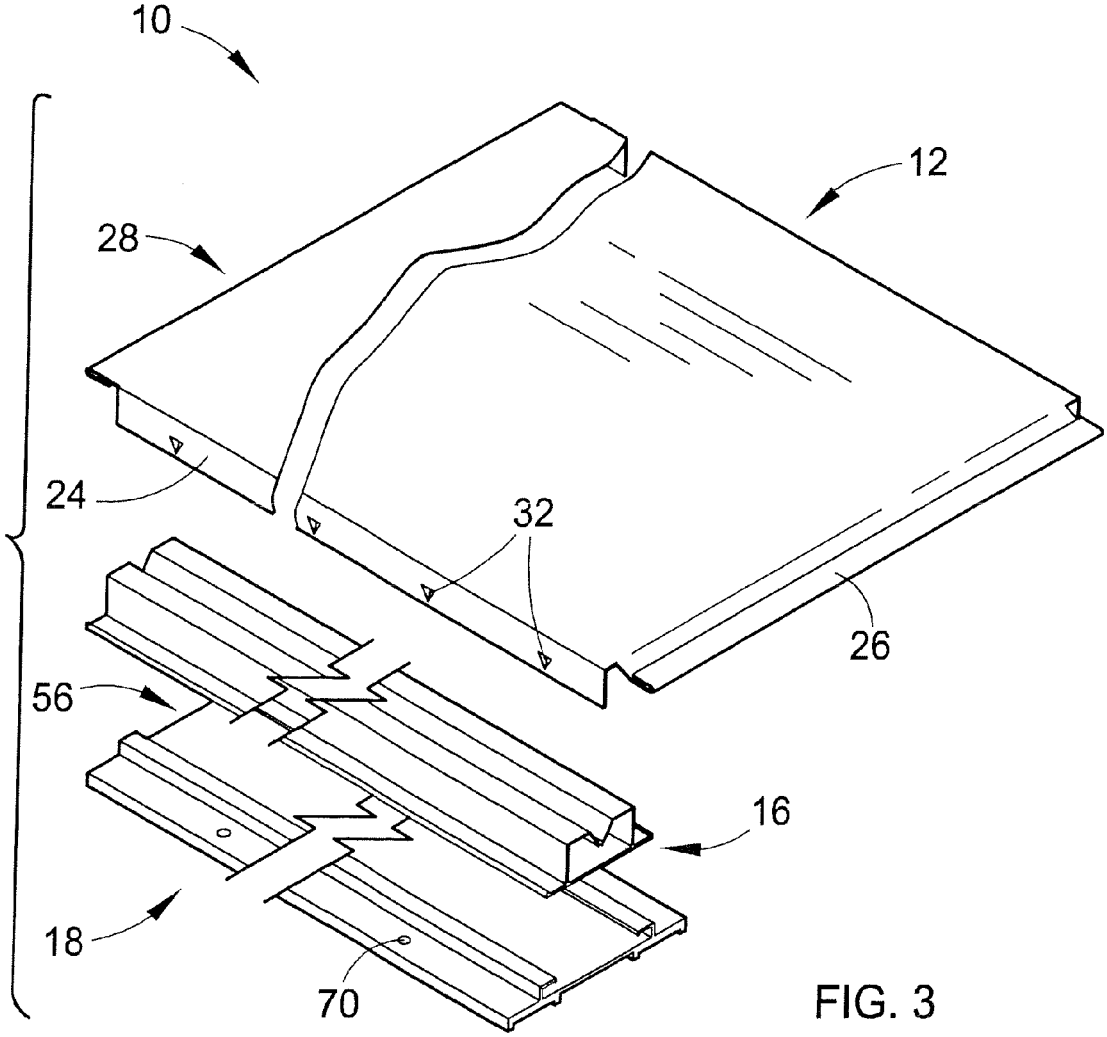
FIG. 3 is an exploded view of the panel and adjacent joint areas of the system of FIG. 1.
Figure 4:
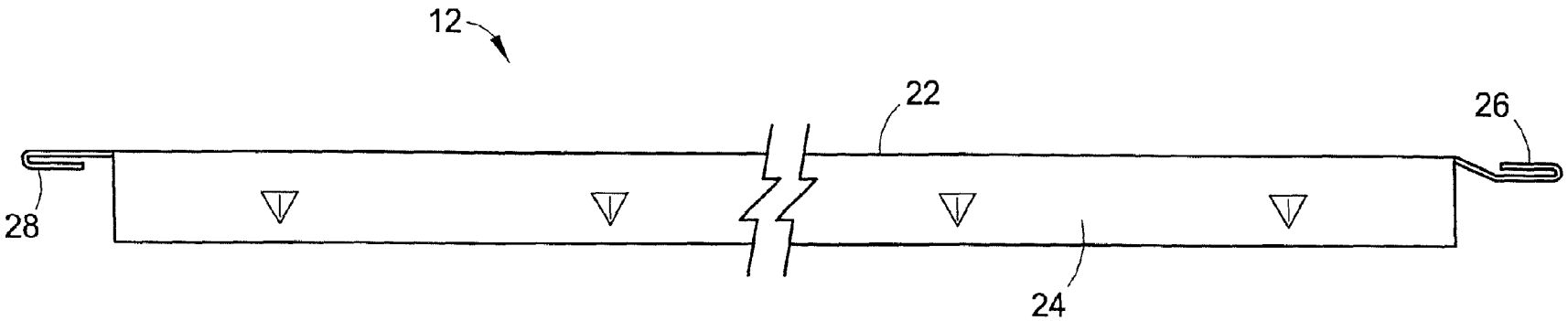
FIG. 4 is a fragmentary side view of the panel of FIG. 1.
Figure 5:
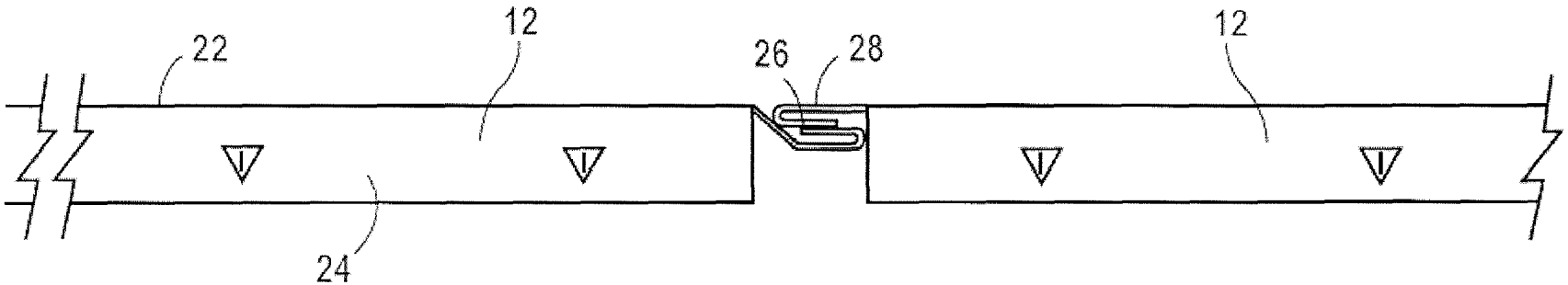
FIG. 5 is a fragmentary side view of the panel of FIG. 1 shown coupling with another similarly configured panel.

As best shown in FIGS. 2 and 3, the panels 12 are of integral construction and are generally rectangular, each including a planar portion 22 and longitudinal flanges 24 which depend perpendicularly from longitudinal edges of the panel 12. The forward edge of each planar portion 22 is folded upwardly and rearwardly into a front lip 26, while the rearward edge is folded downwardly and forwardly into a rear lip 28 for coupling the panels 12 in end-to-end relationship by mating engagement of the lips 26, 28.

The flanges 24 of the panel 12 include a plurality of longitudinally spaced apart protruding locking members 32 which protrude outwardly from an interior surface 33 of the flanges 24. The locking members 32 may be flaps, barbs, hooks, anchors, or other similar elements provided that the locking members 32 are shaped such that they may be easily inserted into a tight location while making it difficult to remove the locking members 32 from the tight location. Thus, the locking members 32 are preferably sloped or pointed, such that an upper section of each locking member 32 is wider than a lower section of each locking member 32. The locking members 32 may have a triangular cross section, such that the upper section of each locking member 32 forms a base of the triangle, while the lower section of each locking member 32 forms an apex of the triangle. Preferably, the locking members 32 are punched or otherwise formed from the same material as the flanges 24 to provide for quick and inexpensive construction, but the locking members 32 may be otherwise added or affixed to the flanges 24.

The retaining member 16 is preferably integral and includes a base 34 and a pair of opposed, upstanding side walls 36,38 extending perpendicularly from the base 34. The base 34 preferably includes a pair of lips 52, 54 along longitudinal edges thereof which protrude vertically to assist in securing the retaining member 16 to the mounting structure 18. Each side wall 36, 38 is connected to a top wall 40, 42 which extend towards each other in a manner that is substantially perpendicular to the side walls 36, 38 and substantially parallel to the base 34. Each top wall 40, 42 is connected to an angled interior wall 44, 46. The angled interior walls 44,46 extend towards a center of the retaining member 16 and converge to form a slot 48 therebetween. Preferably, the slot 48 extends along the retaining member's 16 entire length and is sufficiently wide to accommodate the sequential insertion of two flanges 24 with locking members 32 while the not exceeding twice the width of the locking members 32.

As shown in FIG. 2, the position of the side walls 36, 38, top walls 40, 42, angled interior walls 44, 46, and retaining member base 34 defines a drainage channel 50 in the retaining member 16. The drainage channel 50 collects water, dirt, and other debris that runs from the panels 12 into the joint areas 14 and through the slot 48. The drainage channel 50 is substantially open at both ends of the retaining member 16 to enable the coupling of multiple drainage channels 50.

The mounting structure 18 has a base 56 which includes a pair of grooves 58, 60 for receiving the lips 52, 54 of the retaining member 16. Preferably, each groove 58, 60 is formed by a side rail 62, 64 and a top portion 66, 68. The side rails 62, 64 extend substantially perpendicularly from the base 56 and are attached to the top portions 66, 68 which are substantially perpendicular to the side portions 62, 64 and substantially parallel to the base 56. The top portions 66, 68 extend towards each other and are shaped such that they may fit over the lips 52, 54 of the retaining member 16. The top portions 66, 68 may also contain a downward extending element 69 to assist the grooves 58, 60 in interlocking with the lips 52, 54. As shown in FIG. 3, the base 56 of the mounting structure 18 may include one or more mounting apertures 70 which allow a nail, screw, bolt or other fastener to pass through the base 56 to secure the mounting structure 18 to the surface 20.

The panels 12 are preferably sheet metal of generally rectangular shape, however the ends or sides may be tapered to a trapezoidal shape for special architectural applications. Additionally, the panels 12 are preferably roll formed in 20 to 40 foot (6.1 to 12.2 meter) lengths. The retaining members 16 and mounting structures 18 are preferably extruded, but the panels 12, retaining members 16, and mounting structures 18 may be formed from any durable material. While the panels 12, the retaining members 16, and the mounting structure 18 are of unitary construction, spot welding of components may be employed.

In certain embodiments where a particularly strong surface is required, such as a roof subject to impact or walking loads, a rigid underlayment or rigid polystyrene foam may be employed between retaining members 16 to provide support below the panel surface 22.

In use, the mounting structures 18 are installed at predesigned spaced intervals along the surface 20. The retaining members 16 are attached to the mounting structures 18 by sliding the lips 52,54 of the members 16 into the grooves 58, 60 of the mounting structures 18, such that the lips 52, 54 of the retaining member 16 fit in the grooves 58, 60 by passing underneath the top portions 66, 68 of the mounting structures 18. Alternatively, the retaining members 16 may be directly fastened to the surface 20 without the use of the mounting structures 18 and through the use of nails, screws, bolts, or other fasteners.

Preferably, the retaining members 16 and mounting strictures 18 extend across the entire length of the surface 20. Alternatively, multiple retaining members 16 and multiple mounting structures 18 may be combined in an end-to-end relationship to extend across the entire length of the surface 20. In this case, the multiple retaining members 16 and the multiple mounting structures 18 are aligned such that each retaining members' 16 drainage channel 50 connects to form a composite drainage channel which is preferably continuous across the surface 20. Thus, runoff collected in the drainage channel 50 is channeled away from the surface 20 by passing through the composite drainage channel.

As best shown in FIGS. 1 and 2, two of the panels 12 are installed on either side of the retaining member 16 by inserting the flanges 24 of the panels 12 into the slot 48 of the retaining member 16 such that the locking members 32 are forced under the angled interior walls 44, 46 of the retaining member 16. The locking members 32 prevent the panel 12 from pulling away from the retaining member 16 by contacting the angled interior walls 44, 46 of the retaining member 16 when vertical force is applied. Preferably, the locking members 32 are positioned on the flange 24 such that the panels 12 are coupled snugly with the retaining member 16, thereby limiting the vertical and lateral movement of the panel 12.

Additionally, the locking members 32 may be interlocked with the retaining member 16 in such a manner that lateral movement of the panel 12 within the slot 48 is further restricted, such as by including stops at regular intervals within the slot 48 or retaining member 16. Furthermore, the panels 12 may be additionally secured to the surface 20, retaining member 16, or mounting structure 18 through conventional means to support the locking member 32. Where it is desired for one panel 12 to be installed behind another, the forward panel lip 26 is slid under the rearward lip 28 of an adjacent panel and the remainder of the installation procedure is repeated.

Although the invention has been described with reference to the preferred embodiment illustrated in the attached drawing figures, it is noted that equivalents may be employed and substitutions may be made herein without departing from the scope of the invention as recited in the claims.

The invention claimed is:

1. A panel attachment system comprising:

a plurality of covering panels each presenting a flange and a lip, wherein— the flange extends generally perpendicularly from the panel and includes a planar surface with at least one locking member protruding perpendicularly therefrom and away from the edge of the flange and occupying only a portion of the length of the planar surface, and the lip is operable for mating engagement with a corresponding lip of an adjacent panel by at least partially overlapping the corresponding lip such that at least a portion of the lip rests on top of at least a portion of the corresponding lip;

a plurality of retaining members each having a slot operable to be positioned substantially along the length of one or more of the flanges for receiving the one or more of the flanges and interlocking with the locking member of each of the one or more of the flanges in order to secure the flanges to the retaining member such that the panels are positioned above the retaining member, wherein each retaining member includes a drainage channel positioned proximate the slot and each drainage channel is in register with a drainage channel of at least one adjacent retaining member such that the drainage channels of the plurality of retaining members form a continuous, composite drainage channel spanning all of the retaining members and at least two of the covering panels; and at least one mounting structure for securing the retaining member to a surface, such that the retaining member and the mounting structure are positioned between the panel and the surface.

2. The panel attachment system of claim 1, wherein the retaining member is secured to the mounting structure by sliding the retaining member into the mounting structure.

3. A panel attachment system comprising:

a plurality of covering panels each presenting a flange and a lip, wherein— the flange extends generally perpendicularly from the panel and includes a planar surface with at least one locking member protruding perpendicularly therefrom and away from the edge of the flange and occupying only a portion of the length of the planar surface, and the lip is operable for mating engagement with a corresponding lip of an adjacent panel by at least partially overlapping the corresponding lip such that at least a portion of the lip rests on top of at least a portion of the corresponding lip;

a plurality of retaining members each having a slot for receiving one or more of the flanges and interlocking with the locking member of each of the one or more of the flanges in order to secure the flanges to the retaining member, wherein the slot substantially extends along the retaining members entire length, and wherein each retaining member includes a drainage channel positioned proximate the slot and each drainage channel is in register with a drainage channel of at least one adjacent retaining member such that the drainage channels of the plurality of retaining members form a continuous, composite drainage channel spanning all of the retaining members and at least two of the covering panels; and a plurality of mounting structures for securing the retaining members to a surface, such that the retaining members and the mounting structures are positioned between the panel and the surface.

4. The panel attachment system of claim 3, wherein the retaining member is secured to the mounting structure by sliding the retaining member into the mounting structure.

5. The panel attachment system of claim 3, wherein each drainage channel is configured to collect surface drainage matter passing through the corresponding slot and to channel the matter away from a surface.

6. The panel attachment system of claim 3, wherein the slot is formed between walls rising from a base of the retaining member.

7. A panel attachment system comprising:

a plurality of covering panels each presenting a pair of opposed longitudinal flanges, wherein each flange includes a planar surface with a plurality of discrete locking members protruding perpendicularly therefrom and away from the edge of the flange, at least two of the locking members positioned so as to not directly contact each other and with each locking member occupying only a portion of the length of the planar surface;

a plurality of retaining members each having a slot and a drainage channel positioned below the slot, wherein the slot substantially extends along the retaining member's entire length and is configured for receiving the flanges and interlocking with the locking members in order to secure the flanges to the retaining member, wherein each drainage channel is in register with a drainage channel of at least one adjacent retaining member such that the drainage channels of the plurality of retaining members form a continuous, composite drainage channel spanning all of the retaining members and at least two of the covering panels; and a mounting structure for securing the plurality of retaining members to a surface, such that the retaining members and the mounting structure are positioned between the panel and the surface.

8. The panel attachment system of claim 7, wherein the locking members protrude from an interior side of the longitudinal flanges.

9. The panel attachment system of claim 7, wherein the locking members are integral with the longitudinal flanges.

10. The panel attachment system of claim 7, wherein the locking members are sloped to assist in interlocking with the retaining member.

11. The panel attachment system of claim 7, wherein the slot is formed between a pair of walls extending from the retaining member.

12. The panel attachment system of claim 7, wherein the retaining member is secured to the mounting structure by interlocking the retaining member and mounting structure.

13. The panel attachment system of claim 12, wherein the retaining member and mounting structure are interlocked by sliding the retaining member into the mounting structure.

14. The panel attachment system of claim 7, wherein each drainage channel is configured to collect surface drainage matter passing through the slot and to channel the matter away from the surface.

* * * * *